US005467976A

United States Patent [19]

Doucet

[11] Patent Number: 5,467,976

[45] Date of Patent: Nov. 21, 1995

[54] DEVICE INCLUDING A DIVERTING MECHANISM FOR CHANGING THE CONVEYING DIRECTION OF PRODUCTS IN A FOLDER

[76] Inventor: Louis J. Doucet, 7 Kyle Dr., Salem, N.H. 03079

[21] Appl. No.: 322,721

[22] Filed: Oct. 13, 1994

[51] Int. Cl.[6] ..... B65H 39/10

[52] U.S. Cl. ..... 271/13; 271/184

[58] Field of Search ..... 271/184, 225, 271/300, 302, 303

[56] References Cited

U.S. PATENT DOCUMENTS

| | | | |
|---|---|---|---|
| 3,717,249 | 2/1973 | Faley | 271/302 X |
| 3,866,902 | 2/1975 | Feldkamper . | |
| 4,333,641 | 6/1982 | Peter . | |
| 4,915,371 | 4/1990 | Quinton . | |
| 5,150,894 | 9/1992 | Ricciardi | 271/302 |

FOREIGN PATENT DOCUMENTS

| | | | |
|---|---|---|---|
| 172153 | 10/1983 | Japan | 271/184 |
| 2061235 | of 0000 | United Kingdom . | |

*Primary Examiner*—H. Grant Skaggs
*Attorney, Agent, or Firm*—Kenyon & Kenyon

[57] ABSTRACT

An apparatus including a diverting device for changing the transport direction of products in a folder is provided. Products traveling along a horizontal transport path on a first conveying tape(s) are diverted by the diverting device onto a second conveying tape(s) which forms an inclined transport path. The diverting device includes diverting tapes which are diverted from a position along the horizontal transport path to a position along the inclined transport path by levers which are swivelably mounted on stationary axes.

17 Claims, 4 Drawing Sheets

DEVICE INCLUDING A DIVERTING MECHANISM FOR CHANGING THE CONVEYING DIRECTION OF PRODUCTS IN A FOLDER

FIELD OF THE INVENTION

The invention relates to a device for changing the transport direction of products, particularly in a folding apparatus.

BACKGROUND OF THE INVENTION

In prior art U.S. Pat. No. 4,333,641, a product diverter, is enclosed wherein a gate mender provided with an arcuate recess is coupled with a curved gate member via a linkage. The linkage is movable by means of a pneumatic cylinder. By applying suitable timing pulses, this arrangement becomes a multiple-path diverter system whereby a divergence of the transport path takes place behind the gate member provided with an arcuate recess as well as behind the curved gate mender which dips into circumferential grooves formed in rolls.

U.S. Pat. No. 4,915,371 discloses a sorting device for banknotes, which, during their conveyance, are guided through a switchable deflector being operable by means of an actuating cylinder and then are delivered to a stacking magazine via a stacking wheel.

UK Patent Application GB No. 2 061 235 discloses a conveying and diverting device for a stream of overlapping printed sheets. A flap member being pivotable by means of a pneumatic cylinder is provided in a space of the lower conveying means. A retaining element is provided above the conveying plane in parallel with conveying means which grip the printed products transported in an overlapped arrangement from above. If the pivotable retaining element on the conveying plane is moved upward by means of an actuating cylinder, a retaining portion is projected downwardly, preventing further conveyance of the overlapping printed products, which accumulate on the back side of the retaining portion. This enables an interruption of the production run. However, the device has the disadvantage that a stagnation of the product stream occurs in the original conveying plane.

U.S. Pat. No. 3,866,902 shows an actuating mechanism for a diverter for sheet-like products. The diverter is arranged in a space of the conveying plane. By means of an actuating cylinder the diverter is pivotable into an upper position, as well as into the horizontal conveying plane. The pivot path of the diverter is defined by two abutments formed with setscrews, the positions of the abutments being variable. The conveying plane comprises two upper and two lower transport tapes, with a stationary transport arrangement existing below the pivotable diverter.

All diverting systems of the state of the art mentioned hereinbefore have the common disadvantage that the pivotable diverting elements are of stationary design. The speed of conveyed products, which are conveyed at machine speed is high relative to the diverting elements. High relative speeds of products that come into contact with stationary abutment surfaces—when, for example, the ink on the product is not yet completely cured—can cause smudges on the surfaces of the products. Customers are not generally willing to accept products with such flaws; thus, they are waste.

Also, the systems of the state of the art mentioned above allow partial release of the products while in the diverter area, whereas the present invention provides a means for diverting the products without releasing them.

SUMMARY OF THE INVENTION

In view of the disadvantage common to the systems of the prior art as described above, and in pursuit of further development of the known diverting systems, it is an object of the invention to provide deflection of products out of an original conveying plane into another conveying plane without the occurrence of significant differences in relative speeds.

It is a further object of the present invention to eliminate stationary diverting means.

It is another object of the present invention to avoid the partial release of the products during transfer from one conveying plane to another.

Yet another object of the invention is to ensure complete control of transfer of the product from one conveying plane to another.

These objects are solved, according to the invention, by a device for changing the conveying direction of products in a folding apparatus, in which in a conveying plane there are provided rotatably mounted stationary conveying means, take-over means in an offset arrangement, upper and lower diverting means being arranged in said conveying plane and movable between the stationary conveying means, and means to deflect the upper and the lower diverting tapes to a conveying plane extending parallel to said take-over means.

A device according to the present invention, for changing the direction of conveyance of foldable products carried by a conveying apparatus at a given speed, thus includes a first moving surface adapted to engage and propel foldable products at the given speed, and a first deflection element, coupled to the conveying apparatus, and capable of assuming a first position at a first time and a second position at a second time. The device also includes a first support, coupled to the conveying apparatus and adapted to carry moving surfaces, for bearing the first moving surface, and capable of supporting the first moving surface placed in a first configuration at a first time by the first deflection element assuming its first position, and a second configuration at a second time by the first deflection element assuming its second position, such that the direction of motion of at least a subset of the first moving surface is different in the first configuration than in the second configuration. The device further includes a second moving surface adapted to engage and propel foldable products at the given speed, a second deflection element coupled to the conveying apparatus and capable of assuming a first position at a first time and a second position at a second time, and a second support, coupled to the conveying apparatus and adapted to carry moving surfaces, for bearing the second moving surface, and capable of supporting the second moving surface placed in a first configuration at a first time by the second deflection element assuming its first position and a second configuration at a second time by the second deflection element assuming its second position, such that the direction of motion of at least a subset of the second moving surface is different in the first configuration than in the second configuration. In the first configuration, the moving surfaces carry the foldable products in a first conveying direction, and, in the second configuration, the moving surfaces carry the foldable products in a second conveying direction.

This solution according to the invention has the advantage that, during the entire deflection process, product control can be maintained. Owing to the moving diverting tapes, on which the products are held in the original conveying plane as well as in the deflected conveying plane, relative speed differences with respect to the products to be conveyed do not occur; therefore, smudging effects on the printed surface of the products do not appear. With the deflectable diverting means, a gap in the conveying plane, which may represent a potential risk for interruptions in the conveyance of the products, is eliminated.

In an embodiment of the present invention, the take-over means are designed as stationary conveying tapes that take an inclined position. An adapting curvature can thereby be formed in the inclined transport path. Furthermore, the means for deflecting the upper and lower diverting tapes are pivotable around stationary axes, with the deflection means being designed as levers which dip into spaces between the stationary conveying means. The levers have rollers at their ends which act on the upper and lower diverting tapes. The rollers are mounted in the levers so as to be loosely rotatable.

The levers for directing the deflection means of the diverting tapes dip into spaces between the stationary conveying tapes before the products to be diverted are deposited on the upper transport path. This ensures a controlled deflection of the products to be conveyed onto the lower transport path which is defined by stationary take-over tapes and the lower diverting tapes to be deflected.

Another advantageous embodiment of the invention provides that a number of levers corresponding to the number of upper diverting tapes to be deflected are pivotally mounted on an upper stationary axis. Several rotary bodies are mounted on a lower symmetry axis in spaced relation. When the diverting tapes are deflected, they gradually are guided around the outer cylindrical surface of the rotary bodies, thereby forming an entry into the lower transport path.

According to a further embodiment of the invention, the rotary bodies can also be designed as disks.

In the spaces between the rotary bodies there are provided a number of pivotable levers corresponding to the number of the lower conveying tapes. Furthermore, stationary roller bearers are provided in the regions between the stationary conveying means that are not crossed by the pivotable levers during a pivot movement. The stationary roller bearings provide support for guide rollers as well as support rollers. The support rollers serve to guide the upper diverting tapes during a deflection. A transport path A is defined by stationary conveying means and undeflected upper and lower diverting tapes. A transport path B is defined by stationary take-over tapes revolving around guide rollers and by deflected upper and lower diverting tapes. In the deflected state the upper diverting tapes are in contact with the support rollers of the stationary roller bearer as well as with the outer cylindrical surface of the disk-shaped rotary bodies. In the disengaged state, i.e. during conveyance of products on the transport path A, the rollers of the lower pivotable lever and, thus, the lower diverting tapes are located below the transport path A.

BRIEF DESCRIPTION OF THE DRAWINGS

Further characteristic features of the invention will be explained in the following description, which will be best understood when read in connection with the accompanying drawings, in which.

DETAILED DESCRIPTION

Figure 1:
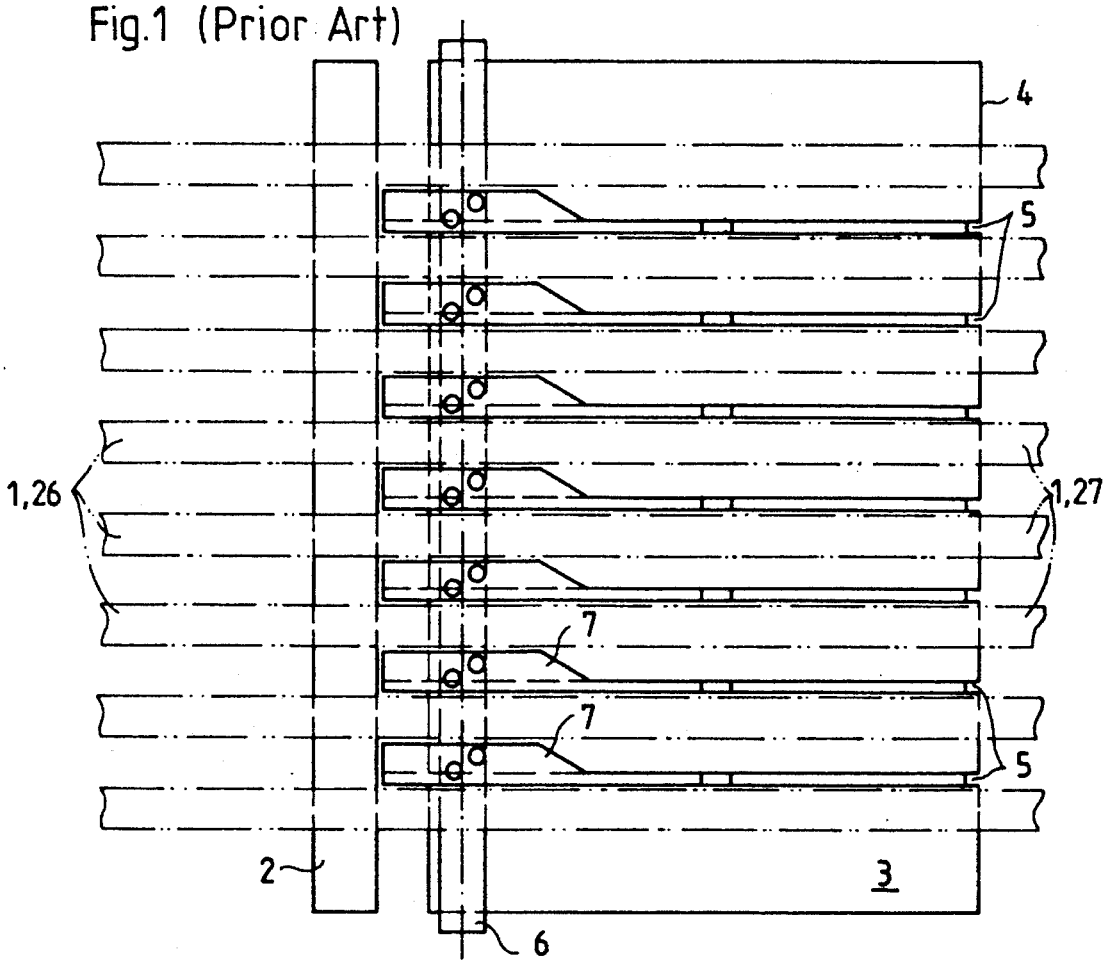
Fig.1 (Prior Art)
FIG. 1 is a top view of a configuration of the prior art.
Figure 2:
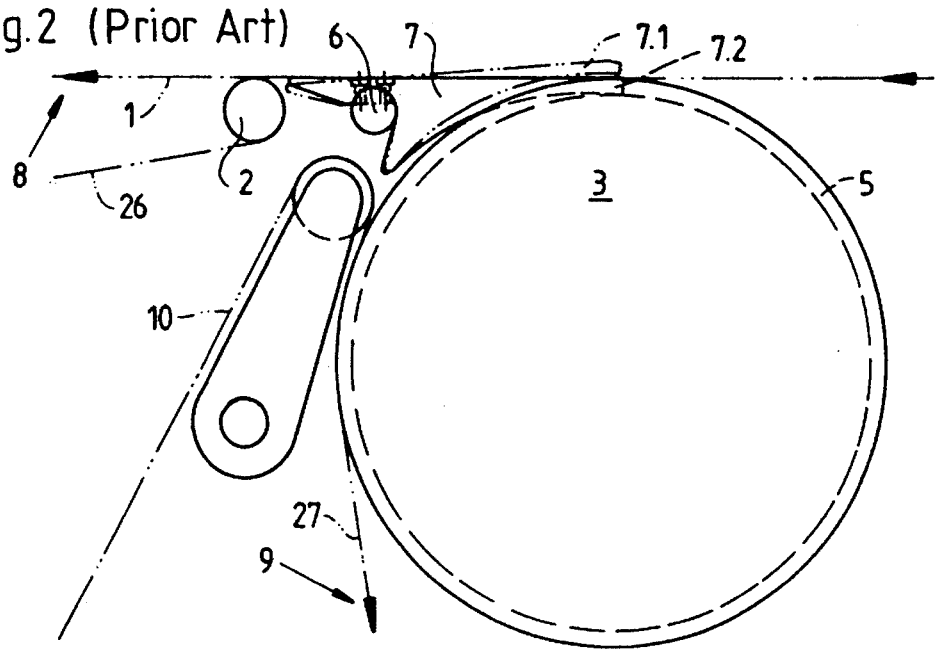
Fig.2 (Prior Art)
FIG. 2 is a side view of a configuration of the state of the art including stationary wedge-shaped diverting elements.

FIG. 1 shows a conveying plane formed by stationary upper conveying tapes 1 and lower conveying tapes 27 which revolve around a cylinder 3. Above the cylinder 3, provided with circular circumferential grooves, there are arranged in a row multiple diverting elements 7 on an actuating shaft 6. As can be seen in connection with FIG. 2 of the illustration of the prior art, the diverting elements 7 take a position 7.1, in which they are extended and disengaged, as well as a position 7.2, in which they are engaged with the outer cylindrical surface of the cylinder 3. When the diverting elements 7 have moved into the position 7.1 in the transport path A (in the drawings referred to with reference numeral 8), they guide the products to be conveyed along the surface of the cylinder 3 in accordance with the curvature of a wedge, until the products are gripped by revolving take-over tapes 10 and lower conveying tapes 27 and moved onto a transport path B (in the drawings referred to with reference numeral 9). When the diverting elements 7 are in position 7.2, the products are guided over them by upper conveying tapes 1 until they are gripped between take-over tapes 26 and the upper conveying tapes 1, which form the transport path A 8 (i.e., reference numeral 8).

Since the deflection elements are non-movable elements, the contact of the curved underside of the diverting elements 7 with the surfaces of the products being moved at machine speed can cause smudges on the product surfaces and, thus, make waste of these products, as mentioned above.

Figure 3:
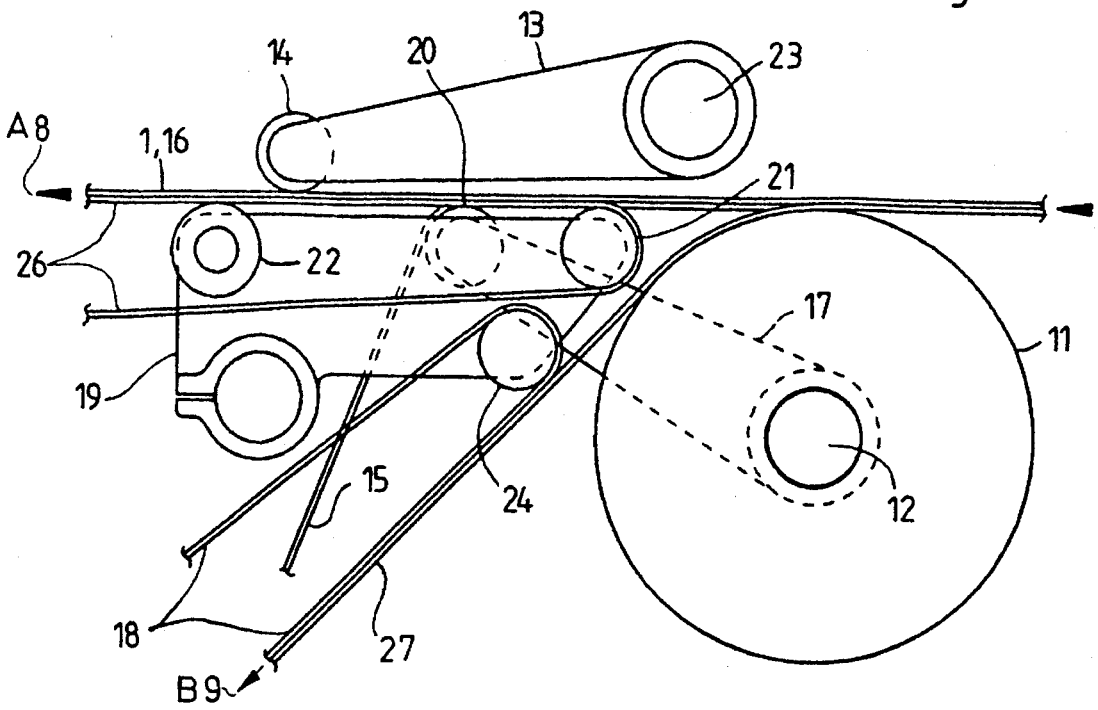
FIG. 3 is a side view of an embodiment according to the invention in a state of rest, indicating conveyance of the products along a transport path A.

FIG. 3 represents a side view of an embodiment of the device according to the present invention. A transport path A 8 as shown herein is defined by stationary upper conveying tapes 1, take-over tapes 26, and diverting tapes 15 and 16 in a non-deflected state. The diverting tapes 16 are situated above the transport path A 8, while the diverting tapes 15 are situated below the transport path A 8. Above the transport path A 8 there is shown a swivel axis 23, and a roller lever 13 is swivelable around it. The front end of the swivelable roller lever 13 acts on the upper diverting tapes 16 and comprises loosely mounted rollers 14. Below the transport path A 8, rotary bodies 11 are supported by an axis 12. Lower roller levers 17 are swivelable about the axis 12. The front ends of the lower roller levers 17 comprise deflection rollers 20, which are in contact with the lower diverting tapes 15.

Additionally, a stationary roller bearer 19 is provided below the transport path A 8. The stationary roller bearer 19 holds support rollers 22, about which the upper diverting tapes 16 are deflected, as well as guide rollers 24, about which conveying means 18, in the form of stationary take-over tapes, revolve in an inclined position. These conveying means 18 form the upper part of the inclined transport path B 9.; The stationary roller bearer 19 further holds guide rollers 21 for the stationary take-over tapes 26. In the state illustrated in FIG. 3, the lower diverting tapes 15 are brought into a position, in which the deflection rollers 20 direct the lower diverting tapes 15 into the transport path A 8 and support the conveyance of the products on the transport path A 8.

Figure 4:
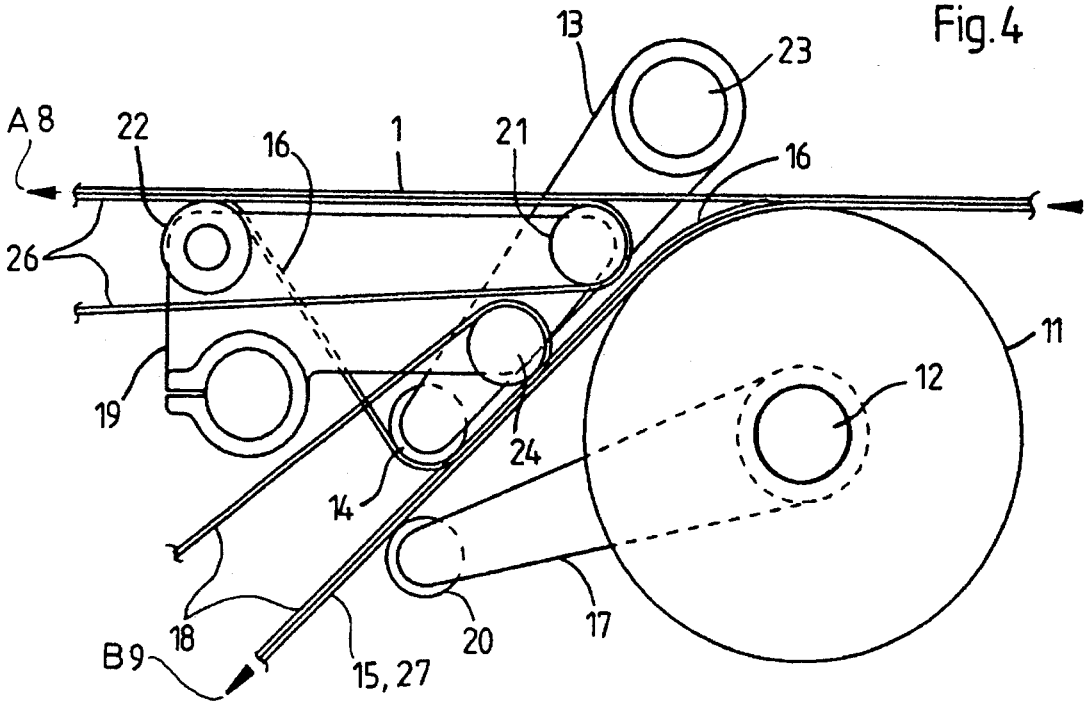
FIG. 4 is an illustration of a deflection of products onto an inclined transport path B by means of a device according to the present invention.

FIG. 4 shows a side view of a configuration according to the invention, wherein the upper roller levers 13 and the lower roller levers 17 are in a deflected position with the lower roller levers 17 in the deflected position. The lower diverting tapes 15, guided around the deflection rollers 20, extend parallel to the stationary take-over tapes 18. At the same time, a deflection of the upper diverting tapes 16 is effected by the deflecting movement of the upper roller levers 13, which are swivelable around the swivel axis 23. The diverting tapes 16 thus move on the circumference of the support rollers 22, as well as on the circumference of the rotary bodies 11. Consequently, the upper roller levers 13, which are swivelable around the swivel axis 23, dip into the free spaces between the stationary conveying tapes 1 and the take-over tapes 26, thereby deflecting the upper diverting tapes 16, which are situated below the deflection rollers 14, out of the upper transport path A 8. Thus, the products conveyed on the transport path A 8 are gripped by the upper diverting tapes 16 and the lower diverting tapes 15, which are engaged with the circumferential surface of the rotary bodies 11 and are moving at machine speed. The products are then guided around the curvature of the rotary bodies 11 and enter the transport path B 9, defined by the stationary take-over means 18, the lower conveying tapes 27 and the deflected lower diverting tapes 15, without having been left to themselves during deflection.

Arranged in the stationary-roller bearer 19, are the guide rollers 24 for the stationary, inclined take-over tapes 18, as well as the guide rollers 21 for the stationary take-over tapes 26 of the transport path A 8. The position and the length of the upper and the lower roller levers 13, 17 allow a timely introduction of the deflection of the products by way of the upper roller levers 13 dipping into the spaces between the stationary conveying tapes 1, so that the products can be guided into the transport path B 9 before they reach the stationary take-over tapes 26.

Figure 5:
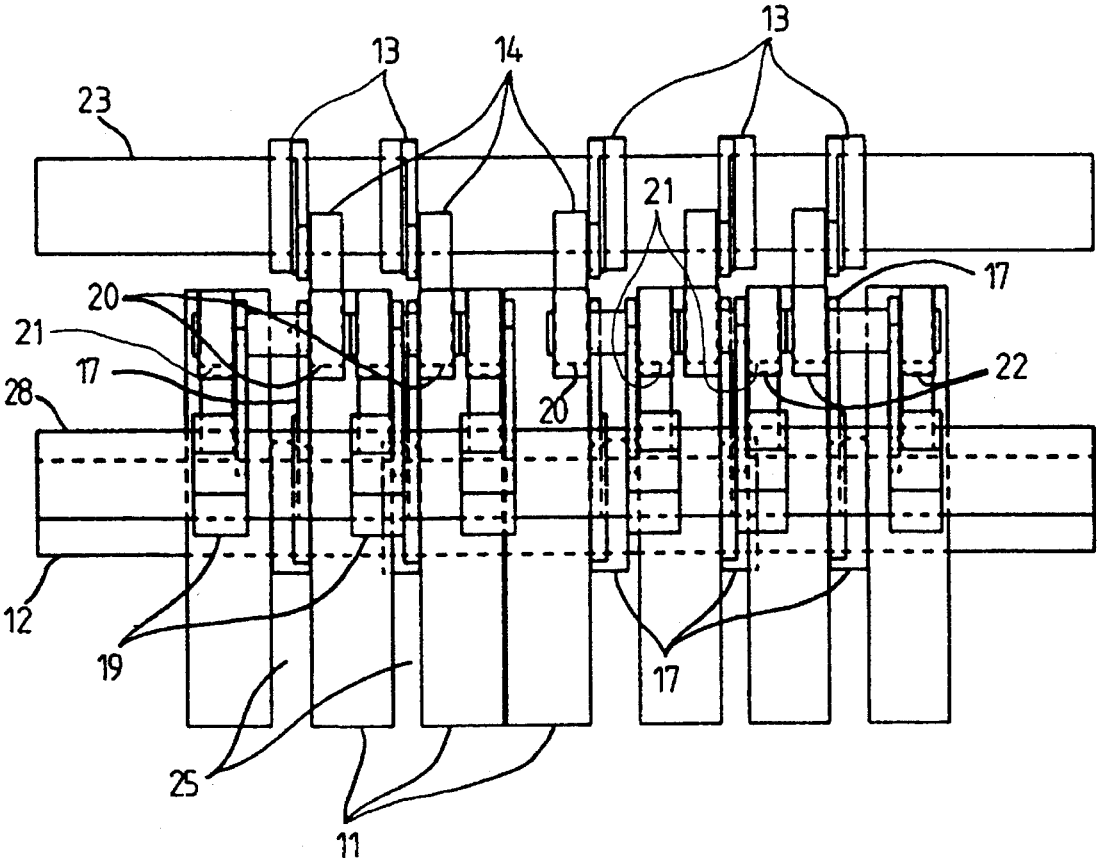
FIG. 5 is an end view of a device according to the present invention.

In FIG. 5 a left end view of a device according to the present invention of FIG. 3 is shown. While in a stationary or first position, multiple roller levers 13 are swivelable around the swivel axis 23. As shown, the upper roller levers 13 are mounted on the swivel axis 23 at a distance from one another. The deflection rollers 14 for the deflection of the upper diverting tapes 16 are shown to be held in the front end of the upper roller levers 13, which partially cover the swivel axis 23. On the symmetry axis 12, there are shown individual rotary bodies 11 which, in this embodiment, are designed as disks. Between the individual rotary bodies 11 are spaces in which there are disposed the bearings of the lower roller levers 17 mounted on the symmetry axis 12. The deflection rollers 20 of the lower roller lever 17 are shown partially covering the circumferential surfaces of the rotary bodies 11. As illustrated, the lower diverting tapes 15, guided by the deflection rollers 20 of the lower roller levers 17, and the upper diverting tapes 16, guided by the deflection rollers 14 of the upper roller lever 13, are in contact with one another. The support rollers 22, around which the upper diverting tapes revolve during deflection, cover the guide rollers 21, around which the stationary take-over tapes 26 revolve, and cover the deflection rollers 20, in the illustration. Thus, a pair of deflection rollers 14, 20 is always located between guide rollers 21, 24 for stationary conveying tapes 1, 18, 26, 27, the guide rollers 21, 24 being fixedly held in the stationary roller bearers 19 and being not deflectable.

Figure 6:
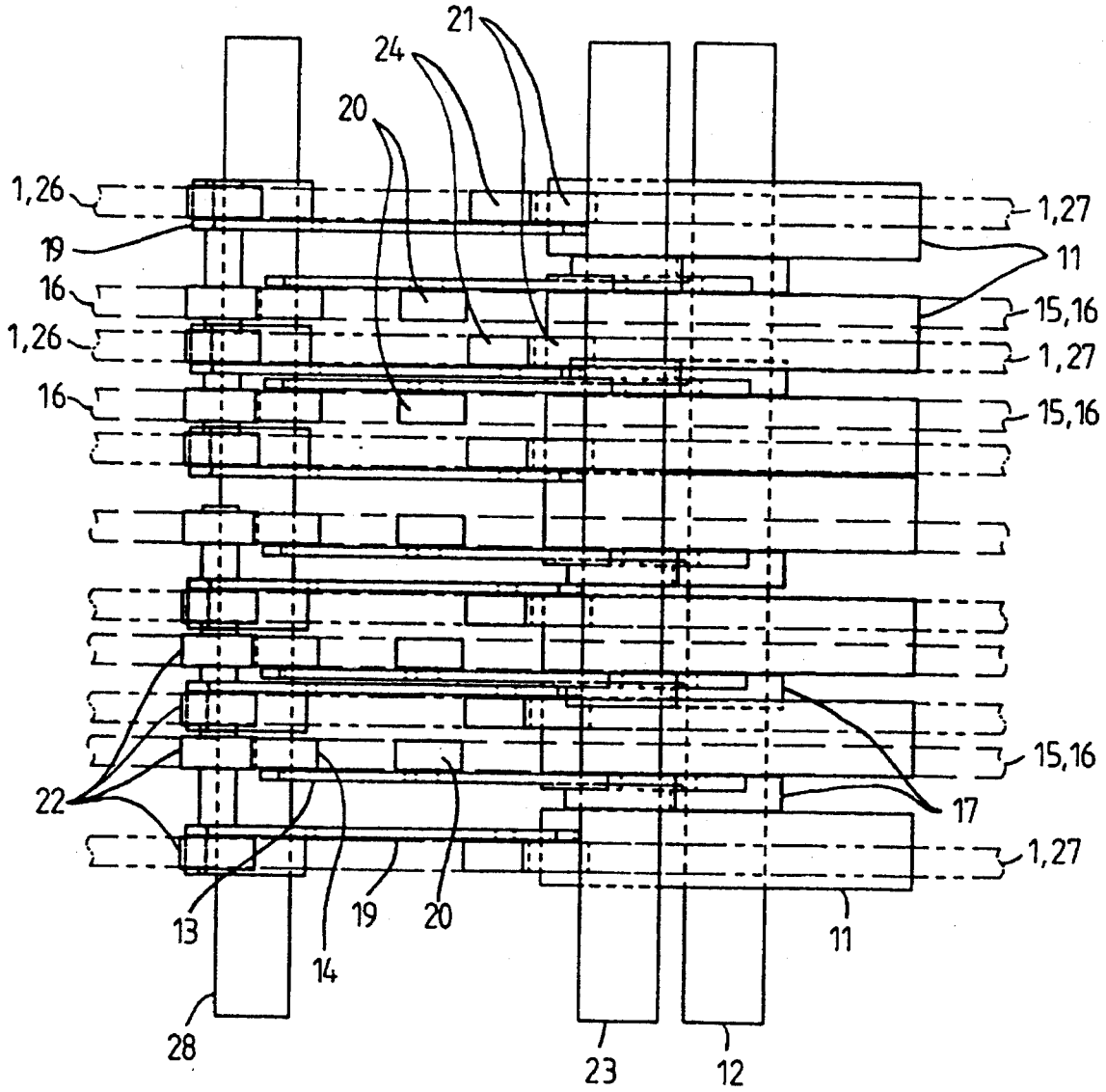
FIG. 6 is a top view of a device according to the present invention.

FIG. 6 is a top view of an embodiment of the present invention. As can be seen therein, the stationary conveying tapes 1, 26, 27 are arranged in groups of two, and between the groups of two there are upper and lower diverting tapes 16, 15 in superimposed position. The symmetry axis 12 supports individual rotary bodies 11, and the stationary conveying tapes 1, 27, as well as the deflectable diverting tapes 15 and 16, are supported by the outer cylindrical surface of the rotary bodies 11. The deflection rollers 14, which are rotatably mounted in the upper roller levers 13, act on the diverting tapes 16. On the roller bearers 19, which are indicated as narrow silhouettes in the top view there are pivotally mounted individual support rollers 22, which support the upper diverting tapes 16 during their deflection. It also can be seen in FIG. 6 that below each stationary conveying tape 1 there is situated a guide roller 24 of the stationary roller bearer 19. Around these guide rollers 24, the stationary, inclined take-over tapes 18 revolve, as illustrated in FIGS. 3 and 4. In this manner, free spaces are created between the stationary conveying tapes 1 and within the stationary, inclined take-over tapes 18, and the upper and lower diverting tapes 16, 15 can be moved into said free spaces through the respectively associated roller levers 13, 17.

The present invention is not limited to the specific embodiment described above, but may be implemented in alternative configurations and with various modifications consistent with the spirit and scope of the invention as expressed in the claims.

What is claimed is:

1. A device for changing the direction of conveyance of foldable products carried by a conveying apparatus at a given speed comprising:

a first moving surface adapted to engage and propel foldable products at the given speed:

a first deflection element coupled to the conveying apparatus and capable of assuming a first position at a first time and a second position at a second time:

a first support, coupled to the conveying apparatus and adapted to carry moving surfaces, for bearing the first moving surface, and capable of supporting the first moving surface placed in a first configuration at a first time by the first deflection element assuming its first position and a second configuration at a second time by the first deflection element assuming its second position, such that the direction of motion of at least a subset of the first moving surface is different in the first configuration than in the second configuration, the first support including a stationary roller bearer:

a second moving surface adapted to engage and propel foldable products at the given speed;

a second deflection element coupled to the conveying apparatus and capable of assuming a first position at a first time and a second position at a second time:

a second support, coupled to the conveying apparatus and adapted to carry moving surfaces, for bearing the second moving surface, and capable of supporting the second moving surface placed in a first configuration at a first time by the second deflection element assuming its first position and a second configuration at a second time by the second deflection element assuming its second position, such that the direction of motion of at least a subset of the second moving surface is different in the first configuration than in the second configuration;

wherein, when the first and second moving surfaces are in their first configuration the moving surfaces carry the foldable products in a first conveying direction, and, when the first and second moving surfaces are in their second configuration, the moving surfaces carry the foldable products in a second conveying direction; and a stationary take-over tape supported in part by the stationary roller bearer of the first support so as to be capable of moving in the second conveying direction.

2. A device for changing the conveying direction of products in a folding apparatus, comprising:

a first conveying mechanism arranged along a horizontal transport path;

a take-over mechanism and a second conveying mechanism [means] arranged along an inclined transport path, the inclined transport path being inclined relative to said first conveying mechanism;

upper and lower diverting mechanisms provided adjacent to the first conveying mechanism on said horizontal transport path; and a deflection mechanism coupled to the upper and lower diverting mechanisms the deflection mechanism deflecting the upper and lower diverting mechanisms onto the inclined transport path.

3. The device according to claim 2, wherein the take-over mechanism comprises stationary take-over tapes arranged along the inclined transport path.

4. The device according to claim 2, wherein the deflection mechanism is swivelable about stationary axes.

5. The device according to claim 4, further including a plurality of rotary bodies mounted so as to have space between one another, the plurality of rotating bodies engaging the first and second conveying mechanisms.

6. The device according to claim 5, wherein the rotary bodies comprise disks.

7. The device according to claim 5, wherein the lower diverting mechanism includes one or more lower diverting tapes, each of the second set of levers being swivelably mounted between the rotary bodies, each one of the second set of levers being associated with a respective one of the lower diverting tapes.

8. The device according to claim 2, wherein the first and second conveying mechanisms each include a plurality of spaced apart conveying members; and the deflection mechanism further includes a first and second set of levers capable of dipping into spaces between the spaced apart conveying members of the first and second conveying mechanisms, respectively, said upper and lower diverting mechanisms residing in the spaces between the conveying members of the first and second conveying mechanisms.

9. The device according to claim 8, further comprising rollers coupled to the ends of the first and second set of levers for acting on the upper and lower diverting mechanisms.

10. The device according to claim 9, wherein the rollers are mounted on the levers so as to be loosely rotatable.

11. The device according to claim 8, wherein the upper diverting mechanism includes one or more upper diverting tapes, the first set of levers being swivelably mounted on an upper stationary axis, each one of the first set of levers being associated with a respective one of the upper diverting tapes.

12. The device according to claim 8, further comprising stationary roller bearers for supporting a plurality of guide rollers, the plurality of guide rollers engaging the first and second conveying mechanisms, the stationary roller bearers disposed between the first and second conveying mechanisms.

13. The device according to claim 2, wherein the horizontal transport path is defined by the first conveying mechanism and the non-deflected upper and lower diverting mechanisms.

14. The device according to claim 2, wherein the inclined transport path is defined by the take-over mechanism revolving around guide rollers, the second conveying mechanism revolving around rotary bodies, and by deflected upper and lower diverting tapes.

15. The device according to claim 2, wherein the upper and lower diverting mechanisms include upper and lower diverting tapes.

16. The device according to claim 2, wherein the first conveying mechanism includes a first conveying belt and a first take-over belt.

17. The device according to claim 2, wherein the second conveying mechanism includes a second conveying belt and the take-over mechanism includes a take-over belt.

* * * * *